US012150561B2

(12) United States Patent
Van Riet

(10) Patent No.: US 12,150,561 B2
(45) Date of Patent: Nov. 26, 2024

(54) BABY CARRIER

(71) Applicant: DAMASI BV, Brasschaat (BE)

(72) Inventor: Peter Van Riet, Antwerp (BE)

(73) Assignee: DAMASI BV, Brasschaat (BE)

( * ) Notice: Subject to any disclaimer, the term of this patent is extended or adjusted under 35 U.S.C. 154(b) by 203 days.

(21) Appl. No.: 17/766,829

(22) PCT Filed: Jul. 8, 2020

(86) PCT No.: PCT/IB2020/056413
§ 371 (c)(1),
(2) Date: Apr. 6, 2022

(87) PCT Pub. No.: WO2021/084328
PCT Pub. Date: May 6, 2021

(65) Prior Publication Data

US 2023/0329449 A1 Oct. 19, 2023

(30) Foreign Application Priority Data

Oct. 28, 2019 (BE) ..... 2019/0094

(51) Int. Cl.
*A47D 13/02* (2006.01)

(52) U.S. Cl.
CPC ..... *A47D 13/02* (2013.01)

(58) Field of Classification Search
CPC ..... A47D 13/02; A47D 13/025
USPC ..... D3/213, 214
See application file for complete search history.

(56) References Cited

U.S. PATENT DOCUMENTS 5,071,047 A * 12/1991 Cordisco ..... A47D 13/025 224/159
5,176,102 A 1/1993 Tracy
5,243,724 A * 9/1993 Barnes ..... A41B 13/06 224/159
5,333,769 A 8/1994 Skroski
D551,443 S * 9/2007 Wilmink ..... D3/214
2010/0051658 A1* 3/2010 Parness ..... A47D 13/02 224/625
2012/0286002 A1* 11/2012 Dardel ..... A47D 13/025 224/159

FOREIGN PATENT DOCUMENTS

DE 102008035752 A1 2/2010
DE 202014009917 U1 3/2016
(Continued)

OTHER PUBLICATIONS

International Search Report and Written Opinion from PCT Application No. PCT/IB2020/056413, mailed Aug. 24, 2020.
(Continued)

*Primary Examiner* — Scott T McNurlen
(74) *Attorney, Agent, or Firm* — Workman Nydegger

(57) ABSTRACT

A baby carrier suitable for carrying a baby against the front of the body of a user; the baby carrier including a first carrying strap with a bucket-shaped part for holding the baby, and a second carrying strap. The baby carrier is configured, during use, for the first carrying strap to be worn crossways in a first loop over one shoulder of the user and the second carrying strap to be worn crossways in a second loop over the other shoulder of the user and thus support the bucket-shaped part crossways.

14 Claims, 4 Drawing Sheets

(56) References Cited

FOREIGN PATENT DOCUMENTS

| | | | | |
|---|---|---|---|---|
| EP | 2389846 | A1 | 11/2011 | |
| FR | 2371906 | A1 | 6/1978 | |
| FR | 2766342 | A1 | 1/1999 | |
| JP | 2005021529 | A | 1/2005 | |
| KR | 473628 | Y1 * | 7/2014 | ..... A47D 13/02 |
| TW | M302899 | U | 12/2006 | |
| WO | 9212656 | A1 | 8/1992 | |
| WO | 9714292 | A1 | 4/1997 | |
| WO | 2004049875 | A1 | 6/2004 | |
| WO | 2021102669 | A1 | 6/2021 | |

OTHER PUBLICATIONS

Belgium Search Report from corresponding BE Application No. 201900094, mailed Mar. 27, 2020.

* cited by examiner

BABY CARRIER

TECHNICAL FIELD

The present invention concerns a carrier suitable for carrying a baby against the body of a user.

PRIOR ART

A baby carrier allows a baby to be carried closely against the user while leaving the user's hands free. As well as subjective requirements such as appearance, general impression and color, a baby carrier must also fulfil various technical requirements. The carrier must be as ergonomic as possible so as to exert minimal load on the muscles and joints of the user. Furthermore, the carrier must be safe for the baby, i.e. the baby must remain securely in the carrier at all times during the most common movements. Furthermore, the baby must be adequately supported. Depending on the baby's age, the baby must be supported under the bottom, the back, the neck and the head. Donning the carrier and installing the child must also be as easy, quick and fault-free as possible.

A known type of baby carrier consists of a cloth which is draped around the child and the wearer in the known fashion. This however is not an obvious action, wherein the user must hold and support the child constantly during draping.

Another known type as presented in WO2012102669A1, WO2004049875A1 and WO9212656A1 consists of a harness part and a carrier part. The harness part consists of flexible straps which are stitched together and provide support for the user, while the carrier part is attached to the harness part and presses the child against the user in an upright attitude, with the face either towards the user or away from the user. One problem with this solution is that the upright attitude is not the most ergonomic position for a baby. Furthermore, when donning the carrier, various connections must be clicked tightly. This is not only complex but also entails a possible risk that a connection can break or not be fully closed.

SUMMARY OF THE INVENTION

It is an object of the present invention to remedy the above-mentioned disadvantages by providing a baby carrier which is ergonomic for both the wearer and the child, which is not susceptible to fault and which can be donned with a minimum of actions.

According to one aspect of the invention, this object is achieved by the provision of a baby carrier suitable for carrying a baby against the front of the body of a user. The baby carrier comprises a first carrying strap and a second carrying strap. The baby carrier is furthermore configured, during use, for the first carrying strap to be worn crossways in a first loop over a shoulder of the user and for a second carrying strap to be worn crossways in a second loop over the other shoulder of the user. The baby carrier furthermore comprises a bucket-shaped part which is at least partially fixedly connected to the first carrying strap and configured to receive the baby in the length direction of the first carrying strap. The second carrying strap is configured, during use, to support the bucket-shaped part or bucket part crossways.

The baby carrier thus consists of two separate looped parts, i.e. the first and second carrying straps, which are worn crossways over the shoulders. The carrying part is furthermore partly a component of the first carrying strap since the first carrying strap is formed in a bucket shape at one position. Therefore there is no separate harness and carrying part. By designing the two straps as loops, the baby carrier can very easily be put on or donned. The baby carrier is namely configured such that firstly, the first carrying strap with the bucket-shaped part and the baby already therein is placed over the head and a first arm, crossways as a first loop over the shoulder of the user, and then the second carrying strap is placed over the head and other arm, crossways as a second loop over the other shoulder of the user. In other words, only two simple and separate actions are required, wherein furthermore no connections need be closed during donning. Because the bucket-shaped part is at least partially fixedly connected to the first carrying strap and configured to receive the baby in the length direction of the first carrying strap, the baby can also be placed directly in the first carrying strap before the baby carrier is donned. This is an advantage in relation to baby carriers which consist solely of elastic straps, in which the baby can only be placed in the carrier after the carrier has been donned. Because the second strap runs crossways over the first strap and over the bucket-shaped part, the baby is furthermore intrinsically secured, i.e. the way in which the carrier is donned also ensures protection of the baby. This means a reduced chance of errors or accidents.

Because the bucket-shaped part is partially integrated in the first strap which runs crossways over the front of the body, and the bucket-shaped part is designed to receive the baby in the length direction of the first carrying strap, the baby automatically lies in a very ergonomic and natural attitude which is defined by the shape of the bucket itself. Bucket-shaped means that the bucket-shaped part is not flat but has a convex form, in which the baby can be laid on its back in an ergonomic fashion. The baby is in fact completely supported by the bucket part from top to bottom. This is also a further advantage over carriers which consist solely of elastic straps, wherein the support is defined by the elasticity of the strap, possibly in combination with the profile of the wearer. Because the bucket-shaped part is also partially a component of the first supporting carrying strap, the baby is automatically pressed against the body, which is both safe and desirable. Furthermore, the position of the first strap ensures that the baby's head lies closely against the heart and chest of the user. This allows breastfeeding while the baby lies in the baby carrier. The system of straps furthermore allows the breasts to be alternated by changing the shoulder over which the carrier is positioned. Furthermore, this attitude also means that the baby can hear the user's heartbeat, which is calming for a baby.

A further advantage of this baby carrier is that the user can sit comfortably during wearing. This is because the baby's legs follow the bucket-shaped part and hence the first strap, and thus do not get in the way when the user sits down. This is different from baby carriers in which the baby's legs hang down.

The bucket-shaped part furthermore preferably comprises an upright wall. Such an upright wall can help create the bucket shape of the bucket-shaped part. The upright wall may partly or fully surround the baby when the baby lies in the bucket-shaped part of the baby carrier, and may help ensure the lateral protection of the baby.

The first carrying strap is preferably connected to the bucket-shaped part at a distance from a first end in the length direction of the bucket-shaped part. The first end in the length direction of the bucket-shaped part may for example be designed to receive the baby's head. A second end in the length direction of the bucket-shaped part may then be designed to receive the baby's legs, and for example may be narrower than the first end. The first carrying strap may for example be connected to the bucket-shaped part at a distance of between 5 cm to around 20 cm, preferably at a distance of for example around 15 cm from the first end in the length direction of the bucket-shaped part, for example at the level of the baby's neck. In this way, the first end in the length direction of the bucket-shaped part may be remote from the first carrying strap, and the baby's head may be supported by the bucket-shaped part outside the first carrying strap at the point where the first carrying strap runs up over the user's shoulder.

Both the first and the second carrying strap may optionally be designed as a closed loop or comprise a closure in order to form the first loop. Although a closure is not essential for the baby carrier, it does allow the first and/or second strap to be adjustable. Thus a rip-tape closure may be provided, or a belt fixing which may be both a closing and an adjustment mechanism. A closed loop however has the advantage that it is easy to don and cannot come loose.

The first carrying strap and/or the second carrying strap are preferably adjustable so that the size of the respective first and/or second loop is adjustable. Alternatively or additionally, the baby carrier may also be provided with a tensioning mechanism, i.e. a mechanism which makes the first and/or second carrying strap adjustable and allows the first and/or second strap to be tightened, and thus shortens or lengthens the first and/or second strap. An exemplary embodiment of such a tensioning mechanism is a cord together with a cord lock, wherein the cord is received in the first and/or second carrying strap.

According to one exemplary embodiment, the tensioning mechanism may comprise a single cord lock which is configured to allow simultaneous adjustment of the first carrying strap and second carrying strap. The cord lock may be configured to lock three cord ends, in particular one end of a first cord which is received in the first carrying strap, and two ends of a second cord which is received in the second carrying strap. In this way, after donning the baby carrier, the carrying straps can be tightened in one or two simple movements until the baby sits securely against the body. Thus the loops may also firstly be made larger in order to simplify donning of the baby carrier.

According to another exemplary embodiment, the first carrying strap and the second carrying strap are attached to each other, for example at the point at which the carrying straps cross on the bucket-shaped part.

According to a further exemplary embodiment, the bucket-shaped part is made of a flexible material, e.g. a flexible textile. This allows the bucket-shaped part to closely follow the shape of the body. The first carrying strap and/or the second carrying strap are also preferably designed to be flexible and non-stretchable.

Furthermore, one edge of the bucket-shaped part, in particular an edge of the upright wall of the bucket-shaped part, may be elastic and/or adjustable. In this way, the baby is further embedded in the bucket-shaped part, which gives a safer and more concealed attitude.

According to a further exemplary embodiment, the bucket-shaped part is adjustable in length.

DESCRIPTION OF EMBODIMENTS

Figure 1C:
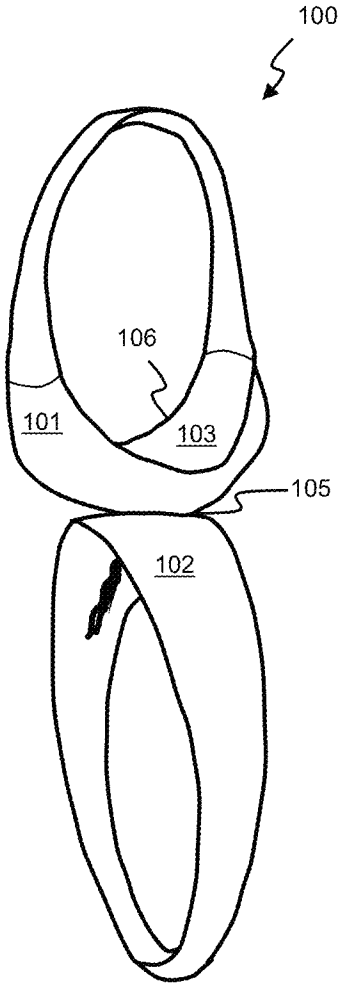
FIG. 1C shows a baby carrier according to one embodiment of the present invention.
Figure 1B:
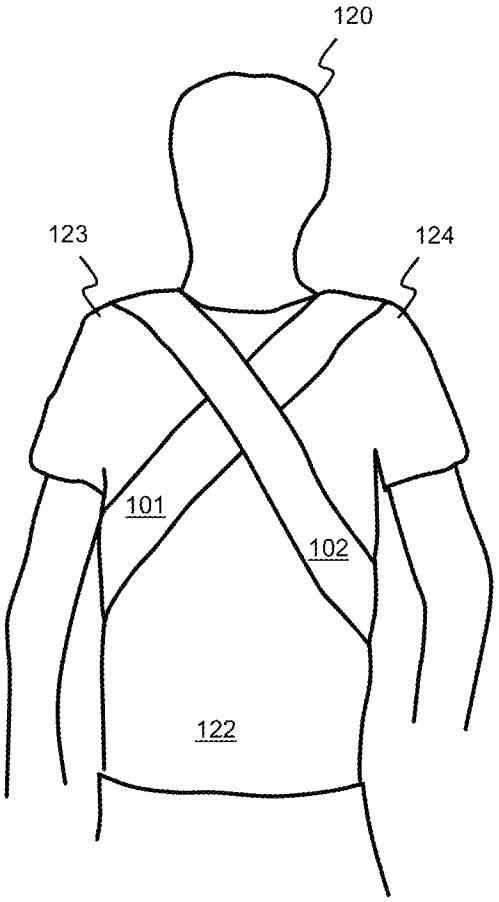
FIG. 1B shows a rear view of a user with a baby carrier according to one embodiment of the present invention.
Figure 1A:
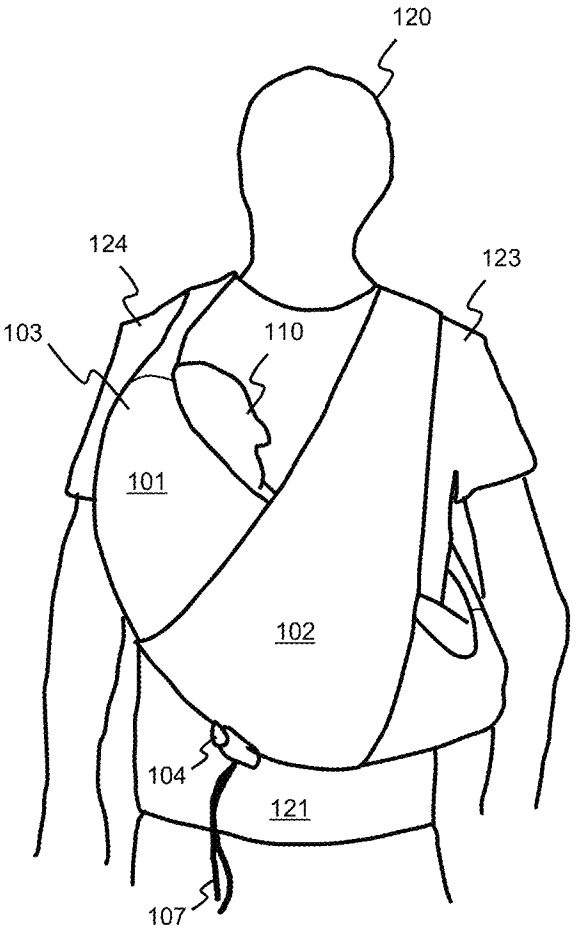
FIG. 1A shows a front view of a user with a baby carrier according to one embodiment of the present invention.

The present invention concerns a baby carrier, i.e. a solution which allows a user to carry a baby while the hands remain free. FIGS. 1A, 1B and 1C show such a baby carrier 100 according to one embodiment, in various states and views. FIG. 1A shows a front view of a user 120 wearing the baby carrier 100 with a baby 110 therein. FIG. 1B shows a rear view of the same user 120 with the baby carrier 100. FIG. 1C shows a view of only the baby carrier 100, i.e. when not being worn by a user.

The baby carrier 100 consists of a first looped strap 101 and a second looped strap 102. A bucket-shaped part 103 is created in the first strap 101, i.e. the bucket-shaped part is part of the loop shape. The bucket-shaped part is furthermore designed to contain the baby 110, wherein the baby is laid in the length direction of the loop and hence of the strap 101. The bucket-shaped part 103 preferably has a length between 50 cm and 80 cm. The bucket-shaped part 103 and the rest of the strap 101 may be two separate components which are permanently connected together, e.g. two pieces of fabric which are stitched together. The bucket may be made of one piece of fabric which is sewn further in order to create the bucket shape. Alternatively, different pieces of fabric may be stitched together to obtain said bucket shape. The bucket 103 may also be made from a three-dimensional printed, knitted, woven or formed, flexible, largely non-stretchable material, so that further seams are avoided. The bucket 103 may on the inside furthermore be provided with protection by which the baby can be buckled into the bucket 103, e.g. by a three-point fixing at the level of the crotch and hips. Preferably, the bucket itself is made of a flexible and non-stretchable material, e.g. a textile. The edge 106 may furthermore be made elastic or adjustable, e.g. by including elastic in the edge 106 or by introducing a cord in the edge 106 which can be tightened by means of a cord lock.

The bucket part 103 may furthermore be made adjustable in length. This may be achieved by making the bucket 103 in two parts which are then fixed so as to overlap. The length can be adjusted by controlling the extent of the overlap. The overlapping parts may furthermore be joined by rip tape, so that the overlapping edges can be separably attached together. Alternatively, one or more belts may be used.

The rest of the strap 101 consists of a flexible material, e.g. a textile. The width of the remaining part is preferably sufficiently wide to keep the pressure on the shoulder 124 as small as possible, but narrower than the actual shoulder width, e.g. from 3 cm to 10 cm. When donning the baby carrier 100, firstly the first strap 101 is placed crossways over the head and shoulder 123 of the user 120. Because of the bucket shape 103 in the first strap 101, the baby 110 may already lie in the strap 101. After donning the first strap 101, said first strap then for example runs over the right shoulder 124, forming the bucket 103, and below the left arm, in order to run over the back 122 up to the right shoulder 124 and thus form a closed loop.

The baby carrier 100 is also provided with the second strap 102. This second strap is also made of a flexible material, e.g. fabric, and is donned after the first strap 101. The second strap 102 is placed crossways over the first strap, i.e. for example starting from the left shoulder 123, the second strap runs over the bucket part 103 of the first strap 101 and below the right arm, and then over the back of the user, crossways over the first strap 101, and back to the left shoulder. The second strap thus supports the first strap and provides extra protection for the baby 110 in the carrier 100. At the level of the bucket 103, the strap 102 may be made wider to guarantee maximum support, e.g. wider than 10 cm, even up to 20 cm, 30 cm or 40 cm. Like the first strap 101, the width of the remaining part is preferably made wide enough to keep the pressure on the shoulder 123 as small as possible, but narrower than the actual shoulder width, e.g. from 3 cm to 10 cm.

The carrier 100 may furthermore be formed in a mirror image or completely symmetrical, so that the carrier can be worn with the baby's head 110 on the left side of the user.

The second strap 102 is attached to the first strap 101, preferably at the level of the lower edge of the bucket 103. In this way, the user can easily adjust the second strap 102 after tightening the first strap 101. Furthermore, this means that the second strap 102 supports the first strap 101 at the correct position, namely on the underside of the bucket 103. Alternatively, the second strap 102 can also be provided separately from the first strap 101, or be attached to the first strap 101 at the crossing point on the back 122.

The baby carrier may also be provided with an adjustment mechanism for adjusting the length of the straps 101, 102. This may be achieved for example by means of one or more cords 107. Such a cord may for example be attached at one end inside the first strap 101, e.g. at the height of the shoulder 124. The cord 107 then runs via the strap 101 to an opening on the underside of the bucket 103. There a cord lock 104 is provided, by means of which the distance to the attachment of the cord can be adjusted. In this way, when tightening the cord 107, the first strap 101 is tightened and the bucket part 103 can be brought closer against the user 120. Additionally or alternatively, such a cord may also be fitted in the second strap 102, attached at one end at the height of the shoulder 123 and adjusted with the same cord lock 104.

Although the straps 101 and 102 need not necessarily be made openable, they may also be provided with a closure, e.g. to allow further adjustment of the straps 101 and 102. Thus a click or clamp buckle may be provided in the straps 101, 102, leaving a loose end which allows the loop to be tightened or loosened.

Alternatively, the straps 101, 102 may be provided with a rip-tape closure which allows the straps to be attached to each other in a separable fashion with an adjustable overlap.

Figure 2:
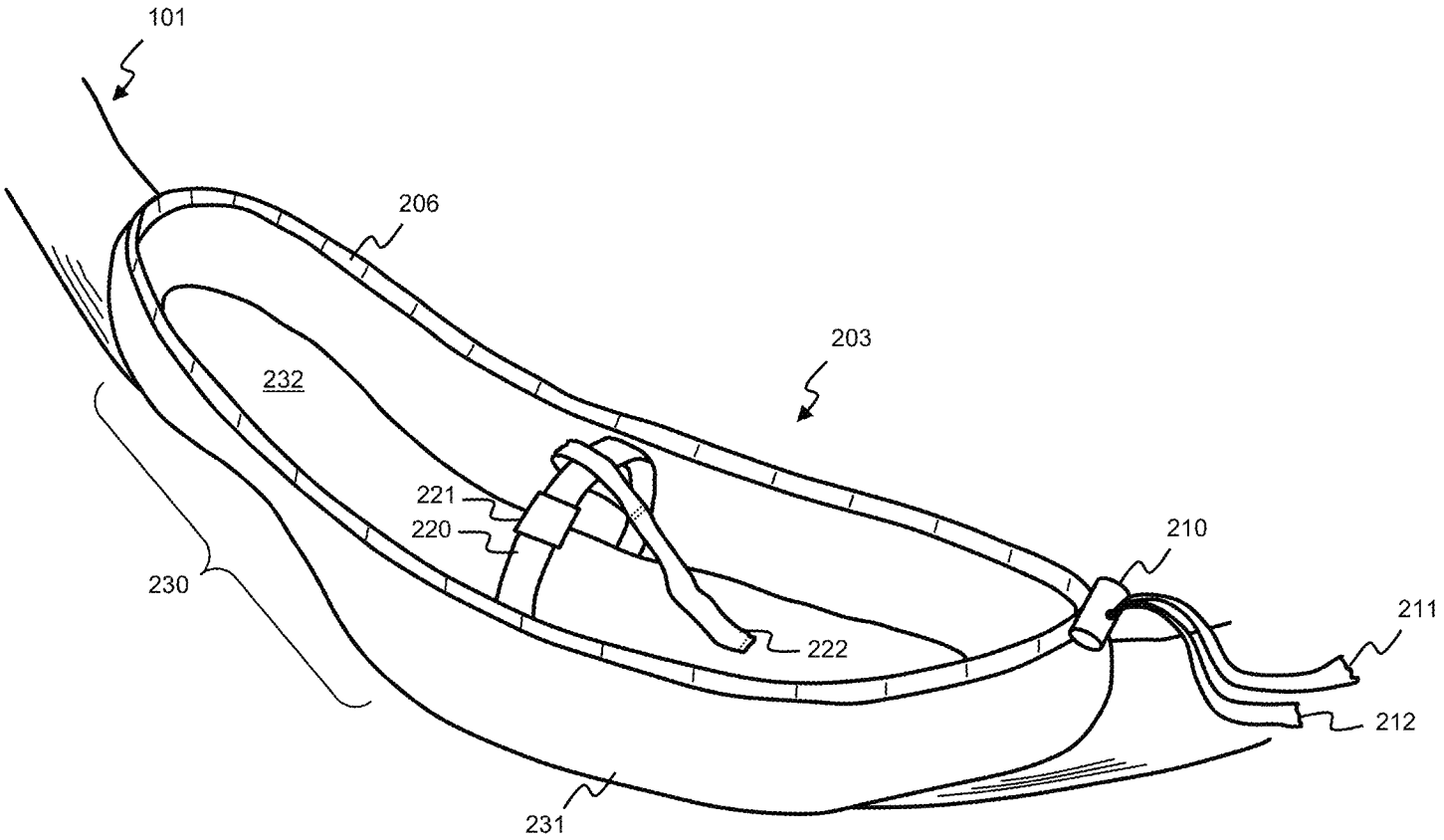
FIG. 2 shows the bucket-shaped part of the baby carrier according to one embodiment of the present invention.

FIG. 2 shows a bucket-shaped part 203 for the baby carrier 100 according to a further embodiment of the present invention. The bucket 203 is made of a back part 232 and a side wall 231. The back part 232 helps form the carrying strap 101. Preferably, the back part 232 has an inwardly curving part 230 at the head end of the bucket 203, i.e. the part 230 which supports the head and upper back of the baby curves slightly inward. The curved part 230 is formed such that the baby's chin is not pressed against the baby's chest. In this way, the baby's breathing is not obstructed during carrying. The curved part may comprise a stiffer material than the rest of the bucket 203, e.g. a piece of pre-formed polyether foam. In some cases, the entire back part, i.e. from the foot end to the head end, may comprise such a stiffer material. The bucket 203 furthermore comprises side walls 231. The side walls 231 may be made continuously with the back part, or alternatively may be attached to the back part by a seam. Preferably, the back part is made flexible and non-stretchable. In this way, the bucket adapts to the shape of the baby and the wearer while the baby remains sufficiently supported. Optionally, the edge 206 of the bucket 203 may be made flexible, e.g. by introducing elastic into the edge 206. Alternatively, the edge 206 may be made adjustable by means of an adjustment mechanism. This may for example be achieved by running a cord through the edge 206 which leaves the edge 206 at the foot end of the bucket 203. By means of a cord lock 210, the ends 211, 212 of the cord can be tightened in order to tighten the edge 206 itself. The bucket 203 may furthermore be provided with one or more buckles 220, 222, with or without a buckle closure and/or buckle adjustment mechanism 221.

Figure 3:
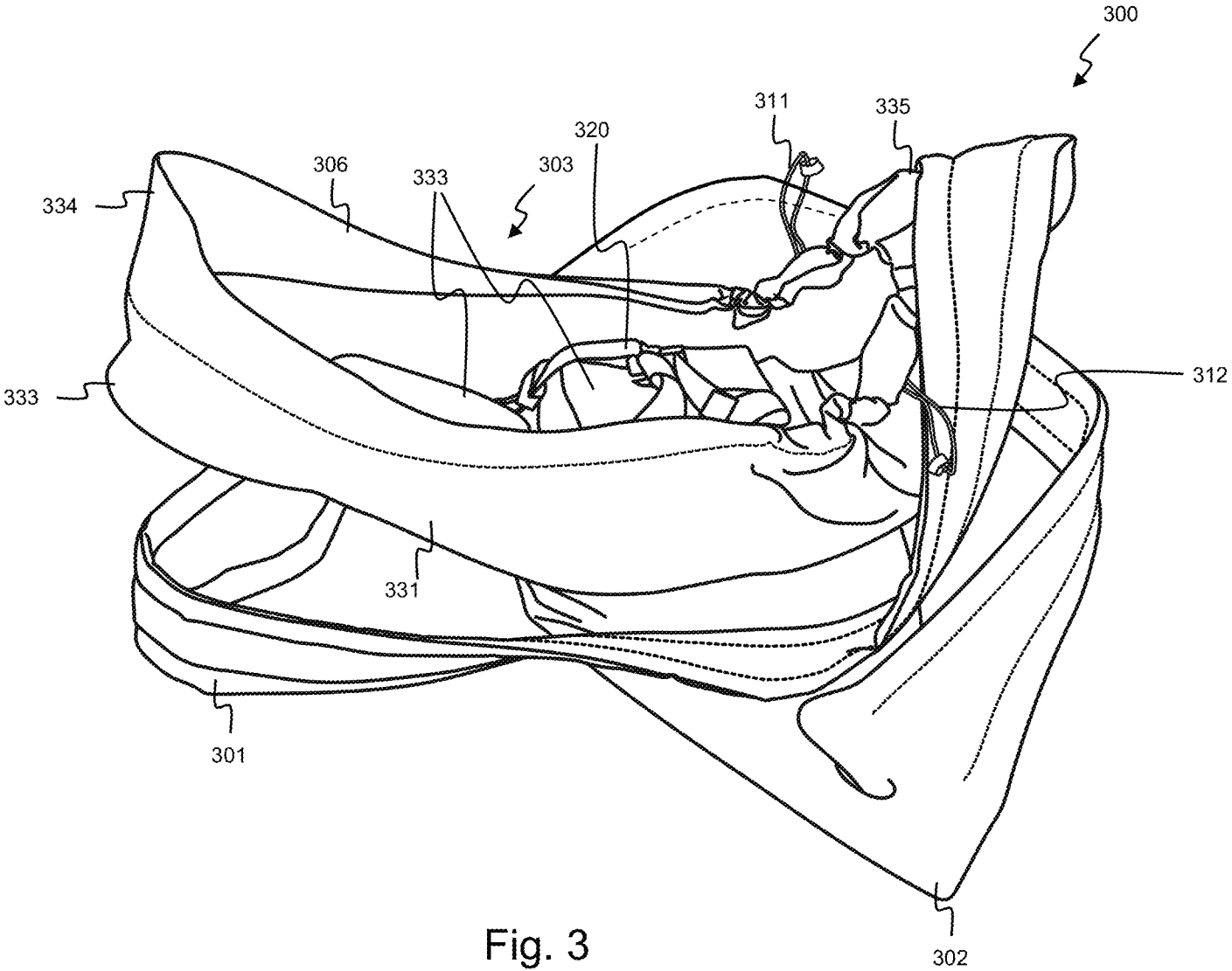
FIG. 3 shows a perspective view of a baby carrier according to one embodiment of the present invention.

FIG. 3 shows a perspective view of a baby carrier according to one embodiment of the present invention. The baby carrier 300 comprises a first carrying strap 301, a second carrying strap 302 and a bucket-shaped part 303. The bucket-shaped part is at least partially fixedly connected to the first carrying strap 301, e.g. stitched onto or into the first carrying strap, and is designed to receive a baby in the length direction of the first carrying strap 301. Just like the embodiment shown in FIG. 2, the bucket-shaped part 303 may comprise an upright wall 331 which partially and preferably completely surrounds the bucket-shaped part 303. The upright wall 331 is preferably made of the same material as the bucket-shaped part 303 and/or the first carrying strap 301, for example made of textile or another flexible material. The edge 306 of the bucket-shaped part 303, in this case of the upright wall 331, may comprise a widening 334 at a first end 333 which is designed to form the head end, said widening being shaped so as to protect the baby's head from incident light. The bucket-shaped part 303 furthermore comprises a back part which lies in the length direction of the first carrying strap 301 and on which the baby may be laid. This back part is in itself already bucket-shaped, for example as a recess, whereby the baby's back and legs preferably do not lie in the same plane. The back part may be partly provided with an extra layer 333 of a material which is less flexible than the material of the baby carrier, in order to provide local additional support for the baby's body, e.g. at the baby's back or under the baby's legs. Such less flexible material, such as e.g. foam rubber or other known materials, may be fixedly worked into the baby carrier or be designed as an insert for temporary use with the baby carrier. Preferably, this additional support at the level of the baby's back does not extend over the entire length of the back part, for example not at the level of the first end 333 or head end. Alternatively, the first end 333 may have a curve which is designed to prevent the baby's chin from being pressed against its chest. Furthermore, this embodiment of the bucket-shaped part 303 may also be provided with one or more buckles 320, with or without buckle closure and/or buckle tensioning mechanism, as already shown in FIG. 2. Optionally, the back part of the bucket-shaped part 303 may comprise two holes which allow the baby's legs to hang outward. Thus the baby carrier can still be used when the baby is larger and wants to assume a more seated position.

The edge 306 of the bucket-shaped part 303, and in particular the edge of the upright wall 331, may comprise an adjustment mechanism, e.g. a cord which runs through the edge 306, and a cord lock. Preferably, the second end 335, which is designed as the foot end, may comprise two lateral cord locks which each lock a cord 311, 312 which runs only along one side of the foot end. In this way, the baby carrier can be better adjusted to the baby's size. Alternatively, the cord may run along a complete side of the bucket-shaped part or along the entire second end 335, i.e. the foot end.

Figure 4:
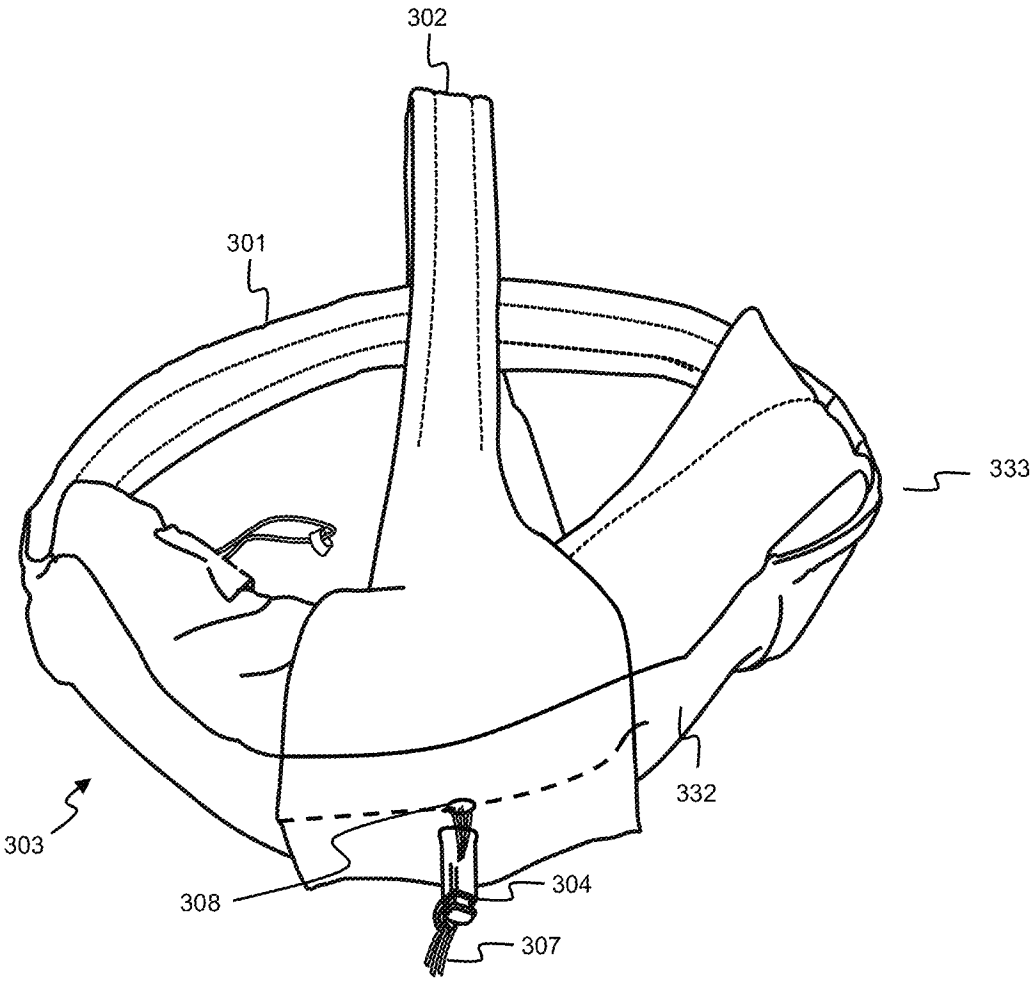
FIG. 4 shows a bottom view of the baby carrier according to the embodiment in FIG. 3.

As shown in FIGS. 3 and 4, the first carrying strap 101 is preferably connected to the bucket-shaped part 103 at a distance from the first end 333 in the length direction of the bucket-shaped part 303, in particular at the level of the baby's shoulders. In this way, the first carrying strap 301 can easily hang over the wearer's shoulder without the baby's head needing to follow the curve of the first carrying strap. In addition, slightly larger babies can still be carried comfortably with the baby carrier. A connection may be made between the first carrying strap 301 and the back part 332 of the bucket-shaped part 303, or the first carrying strap 301 may transform seamlessly into the back part 332.

FIG. 4 shows a bottom view of the baby carrier according to the embodiment in FIG. 3. The first carrying strap 301 and the second carrying strap 302 are preferably attached to each other, more specifically attached to each other crossways at the level of the bucket-shaped part 303. The fixing may take place for example by stitching the straps together at one or more points, or in another known fashion depending on the material from which the carrying straps are made. In this way, the first carrying strap 301 and the second carrying strap 302 cross each other under the baby's bottom and lower back, which promotes the ergonomic support of the baby. Preferably, the second carrying strap 302 furthermore comprises a widening with respect to the shoulder width of the carrying strap, at the point at which the bucket-shaped part 303 and the first carrying strap 301 cross, in order to further promote the support of the baby.

Preferably, the first carrying strap 301 and the second carrying strap 302 are formed as a loop. The baby carrier may comprise an adjustment mechanism 304 for adjusting a length of the loops, preferably by means of one or more cords 307. In a preferred embodiment, a first cord is attached at one end inside the first carrying strap 301, e.g. at the height of the attachment of the first carrying strap 301 to the bucket-shaped part 303 at the first end 333. The cord 307 then runs via the strap 301 to an opening 308 on the underside of the bucket 303. A second cord may run through the second carrying strap 302, for example through the complete loop of the second carrying strap, and also reach the outside through the same opening 308. There a cord lock 304 is provided which is designed to allow simultaneous adjustment of the first carrying strap and the second carrying strap; here, three ends of two cords can be adjusted by means of a single cord lock 304, in particular one end of a first cord which is received in the first carrying strap 301, and two ends of a second cord which is received in the second carrying strap 302. In this way, when tightening the first strap 301, the second strap 302 is also tightened and the bucket-shaped part 303 lies more closely against the user. Alternatively, an adjustment mechanism may be implemented in another fashion.

The above embodiments relate to a baby carrier. The carrier may also be used for carrying small domestic animals such as cats and dogs, i.e. as an animal carrier.

Although the present invention is illustrated with reference to specific embodiments, it will be clear to the person skilled in the art that the invention is not restricted to the details of the above illustrative embodiments, and that the present invention may be executed with various changes and adaptations without leaving the scope of application of the invention. The present embodiments must therefore be regarded as illustrative in all respects and not as restrictive, wherein the area of application of the invention is described by the appended claims and not by the description above, and all changes which fall within the meaning and scope of the claims are therefore also included. In other words, it is assumed all changes, variations or equivalents are included which fall within the scope of application of the present basic principles, and the essential attributes of which are claimed in this patent application. In addition, the reader of this application will understand that the term "comprising" or "comprise" does not exclude other elements or steps, that the word "a" does not exclude pluralities, and that a single element such as a computer system, a processor or other integrated unit may fulfil the functions of different aids specified in the claims. Any references in the claims should not be regarded as a restriction of the claims in question. The terms "first", "second", "third", and "a", "b", "c" and similar, where used in the description or the claims, serve to distinguish between similar elements or steps and do not necessarily describe a successive or chronological order. In the same way, the terms "top", "bottom", "above", "below" and similar serve for the purpose of description and do not necessarily refer to relative positions. It must be understood that these terms are mutually interchangeable under appropriate circumstances and that embodiments of the invention are able to function according to the present invention in different orders or orientations than those described or illustrated above.

The invention claimed is:

1. A baby carrier suitable for carrying a baby against a front of a body of a user, the baby carrier comprising a first carrying strap and a second carrying strap, wherein the baby carrier is furthermore configured, during use, for the first carrying strap to be worn crossways in a first loop over one shoulder of the user and the second carrying strap to be worn crossways in a second loop over the other shoulder of the user, wherein the baby carrier furthermore comprises a bucket-shaped part which is at least partially fixedly connected to the first carrying strap and is arranged to receive the baby in length direction of the first carrying strap, wherein the second carrying strap is configured to support the bucket-shaped part crossways during use, wherein the first carrying strap is connected to the bucket-shaped part at a distance from a first end in length direction of the bucket-shaped part, the first end being remote from the first carrying strap and arranged to support a head of the baby outside an area of the first carrying strap at a point where the first carrying strap runs up over the one shoulder of the user;

wherein the first carrying strap and the second carrying strap are attached to each other crossways at the level of the bucket-shaped part.

2. The baby carrier according to claim 1, wherein the bucket-shaped part comprises an upright wall.

3. The baby carrier according to claim 1, wherein the first carrying strap is a closed loop.

4. The baby carrier according to claim 1, wherein the second carrying strap is a closed loop.

5. The baby carrier according to claim 1, wherein the first or second carrying strap is adjustable so that a size of the respective first or second loop is adjustable.

6. The baby carrier according to claim 1, wherein the first or second carrying strap is adjustable by a tensioning mechanism.

7. The baby carrier according to claim 6, wherein the tensioning mechanism comprises a single cord lock which is configured to allow simultaneous adjustment of the first carrying strap and the second carrying strap.

8. The baby carrier according to claim 7, wherein the cord lock is designed to lock three cord ends, in particular one end of a first cord which is received in the first carrying strap, and two ends of a second cord which is received in the second carrying strap.

9. The baby carrier according to claim 1, wherein the bucket-shaped part is flexible and non-stretchable.

10. The baby carrier according to claim 1, wherein the first carrying strap and/or the second carrying strap is flexible and non-stretchable.

11. The baby carrier according to claim 1, wherein an edge of an upright wall portion of the bucket-shaped part is elastic and/or adjustable.

12. The baby carrier according to claim 1, wherein the bucket-shaped part is adjustable in length.

13. The baby carrier according to claim 1, which is configured such that when donning the baby carrier:

the first carrying strap with the bucket-shaped part and baby therein is placed over the head and a first arm, crossways as the first loop over the shoulder of the user;

then the second carrying strap is placed over the head and other arm, crossways as the second loop over the other shoulder of the user.

14. A baby carrier suitable for carrying a baby against a front of a body of a user, the baby carrier comprising a first carrying strap and a second carrying strap, wherein the baby carrier is furthermore configured, during use, for the first carrying strap to be worn crossways in a first loop over one shoulder of the user and the second carrying strap to be worn crossways in a second loop over the other shoulder of the user, wherein the baby carrier furthermore comprises a bucket-shaped part which is at least partially fixedly connected to the first carrying strap and is arranged to receive the baby in length direction of the first carrying strap, wherein the second carrying strap is configured to support the bucket-shaped part crossways during use, wherein the first carrying strap is connected to the bucket-shaped part at a distance from a first end in length direction of the bucket-shaped part, the first end being remote from the first carrying strap and arranged to support a head of the baby outside an area of the first carrying strap at a point where the first carrying strap runs up over the one shoulder of the user;

wherein the first or second carrying strap is adjustable by a tensioning mechanism;

wherein the tensioning mechanism comprises a single cord lock which is configured to allow simultaneous adjustment of the first carrying strap and the second carrying strap.

* * * * *